US005775431A

United States Patent [19]

Ondracek

[11] Patent Number: 5,775,431

[45] Date of Patent: Jul. 7, 1998

[54] DRY SPRINKLER ARRANGEMENTS

[75] Inventor: Jiri Ondracek, Danbury, Conn.

[73] Assignee: The Reliable Automatic Sprinkler Co., Inc., Mount Vernon, N.Y.

[21] Appl. No.: 712,274

[22] Filed: Sep. 11, 1996

[51] Int. Cl.[6] ..... A62C 35/68

[52] U.S. Cl. ..... 169/37; 169/38

[58] Field of Search ..... 169/37, 38, 39, 169/40, 41

[56] References Cited

U.S. PATENT DOCUMENTS

| | | | |
|---|---|---|---|
| 306,662 | 10/1884 | Stratton | 169/40 |
| 1,903,150 | 3/1933 | Tyden . | |
| 2,180,258 | 11/1939 | Rowley . | |
| 2,211,399 | 8/1940 | Winslow | 169/39 |
| 2,291,813 | 8/1942 | Knight . | |
| 2,291,818 | 8/1942 | Loepsinger . | |
| 3,007,528 | 11/1961 | Gloeckler . | |
| 3,061,015 | 10/1962 | Cann, Jr. . | |
| 3,067,823 | 12/1962 | Kavanagh . | |
| 3,080,000 | 3/1963 | Gleockler . | |
| 4,007,878 | 2/1977 | Anderson . | |
| 4,091,872 | 5/1978 | Mountford . | |
| 4,177,862 | 12/1979 | Bray . | |
| 4,220,208 | 9/1980 | Jackson et al. . | |
| 4,228,858 | 10/1980 | Sclafani . | |
| 4,417,626 | 11/1983 | Hansen . | |
| 5,188,185 | 2/1993 | Mears . | |
| 5,415,239 | 5/1995 | Kötter et al. | 169/37 |

FOREIGN PATENT DOCUMENTS

| | | | |
|---|---|---|---|
| 956561 | 1/1957 | Germany | 169/41 |
| 2816369 | 10/1978 | Germany | 169/37 |
| 921583 | 4/1982 | U.S.S.R. | 169/37 |

*Primary Examiner*—Gary C. Hoge
*Attorney, Agent, or Firm*—Brumbaugh, Graves Donohue & Raymond

[57] ABSTRACT

In the particular embodiments described in the specification, a dry sprinkler has a tube-like section with a sprinkler head at one end and a threaded portion to be received in a water supply line at the opposite end and it includes an internal support structure extending between a sealing plug in the end to be received in the water supply line and a cap in the sprinkler head which is supported by a thermally responsive structure. In one embodiment, the support structure includes a rod on which the sealing plug is mounted at one end and having a cap-engaging tip at the opposite end which is shaped to facilitate the flow of water from the sprinkler head toward a deflector, the rod being spaced from the tube-like section by two guide members, one of which acts as a stop for motion of the structure toward the sprinkler head and the other which engages a spring urging the structure toward the sprinkler head. In other embodiments, a spacer is inserted between the end of the rod and the cap in the sprinkler head and a separate rod tip may be inserted between the rod and the spacer.

7 Claims, 5 Drawing Sheets

DRY SPRINKLER ARRANGEMENTS

BACKGROUND OF THE INVENTION

This invention relates to dry sprinkler arrangements for fire protection systems and, more particularly, to new and improved dry sprinkler arrangements which more effectively convey water to a sprinkler deflector.

Conventional dry sprinklers for fire protection systems include a pipe connected at one end to a sprinkler head having a thermally responsive device and a deflector and at the other end to a water supply line and they include a valve or sealing plug at the end of the pipe joined to the water supply line to prevent pressurized air, nitrogen or water from entering the pipe until the thermally responsive device in the sprinkler head has been actuated. Such dry sprinkler arrangements usually include a rod or tube within the pipe separating the sprinkler head from the sealing plug to retain the plug in its sealing position until the sprinkler has been actuated. Following actuation, the inner rod or tube moves away from the supply line and projects out of the pipe toward the sprinkler head deflector, partially interfering with the flow of water toward the deflector. Moreover, after actuation the plug may be retained within the pipe in a position which also interferes with the flow of water through the pipe toward the sprinkler head.

Certain prior art dry sprinkler arrangements have been proposed to alleviate these problems, but they often require complex and potentially unreliable structural arrangements. For example, U.S. Pat. Nos. 2,180,258, 3,061,015, 3,080,000, 4,417,626, and 4,228,858 disclose dry sprinkler arrangements in which a loose plug releasably held in a sealing position at the end of the dry sprinkler adjacent to the water supply is intended to pass through the dry sprinkler and be ejected from the sprinkler after actuation. These arrangements require releasable plug-holding elements, such as balls or the like, which are designed to move away from a plug-supporting position and to be ejected through the dry sprinkler with the plug when the sprinkler is actuated.

U.S. Pat. No. 5,188,185, on the other hand, discloses a dry sprinkler arrangement having a sealing plug at the end adjacent to the water supply line which is pivotally mounted on the projecting ends of a yoke member supported from the sprinkler head by an internal tube extending through the dry sprinkler. A spring surrounding the yoke member extends between projecting tabs on the yoke member and the adjacent end of a water supply line connection at the water pipe to urge the yoke member toward the sprinkler head. The water supply line connection has a radially enlarged opening providing room for the plug to be rotated 90° on the yoke when the sprinkler is actuated so as to displace the plug from the path of water flowing through the sprinkler head. Such prior art systems are complex in structure and expensive to manufacture.

SUMMARY OF THE INVENTION

Accordingly, it is an object of the present invention to provide a dry sprinkler arrangement which overcomes the disadvantages of the prior art.

Another object of the invention is to provide a dry sprinkler arrangement having a sealing plug support structure which avoids interference with the flow of water through the sprinkler when actuated.

A further object of the invention is to provide a dry sprinkler arrangement having a sealing plug support structure which facilitates the flow of water toward a sprinkler deflector following actuation of the sprinkler.

These and other objects of the invention are attained by providing a dry sprinkler which includes a tube-like section having a sprinkler head with a deflector at one end and having an internal support structure for supporting a sealing plug to seal the opposite end which seal is releasable upon actuation of the sprinkler head and including an internal spring urging the internal support structure toward the sprinkler head, wherein the internal support structure is constructed to facilitate the flow of water through the pipe and toward the deflector at the sprinkler head upon actuation of the sprinkler.

According to one embodiment, the internal support structure includes a support member extending through the pipe and having longitudinally spaced guides for guiding the support member generally centrally therein, one of the guides constituting a stop for stopping motion of the support member in the direction toward the sprinkler head and another of the guides engaging one end of the internal spring. In this embodiment, the end of the support member adjacent to the sprinkler head is shaped to minimize obstruction to water flowing toward the deflector and the opposite end carries a plug for sealing the dry sprinkler from the water supply line, the support member being arranged to displace the sealing plug upon actuation of the sprinkler and to facilitate the flow of water through the pipe. An alternative arrangement includes a spacer, ejectable upon actuation of the sprinkler, by which the end of the support member is normally supported from a cap held in place by a sprinkler actuation arrangement. If desired, the end of the support member engaging the cap or the spacer may be separable from the remainder of the support member.

According to a further embodiment, the support member abuts the sealing plug and is shaped so as to displace the plug laterally from the water flow path when the sprinkler is actuated. In this embodiment, the tube-like section is mounted to the water supply line connection which is engageable with the water supply line and which has a lateral recess to receive the displaced sealing plug out of the water flow path upon actuation and the end of the plug support member has tapered end portions to divert the plug into the recess when the sprinkler is actuated. If desired, the support member may be supported from the cap and the sprinkler actuating mechanism by a split ring which is ejectable from the pipe when the sprinkler is actuated, thus clearing the water flow path.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 1:
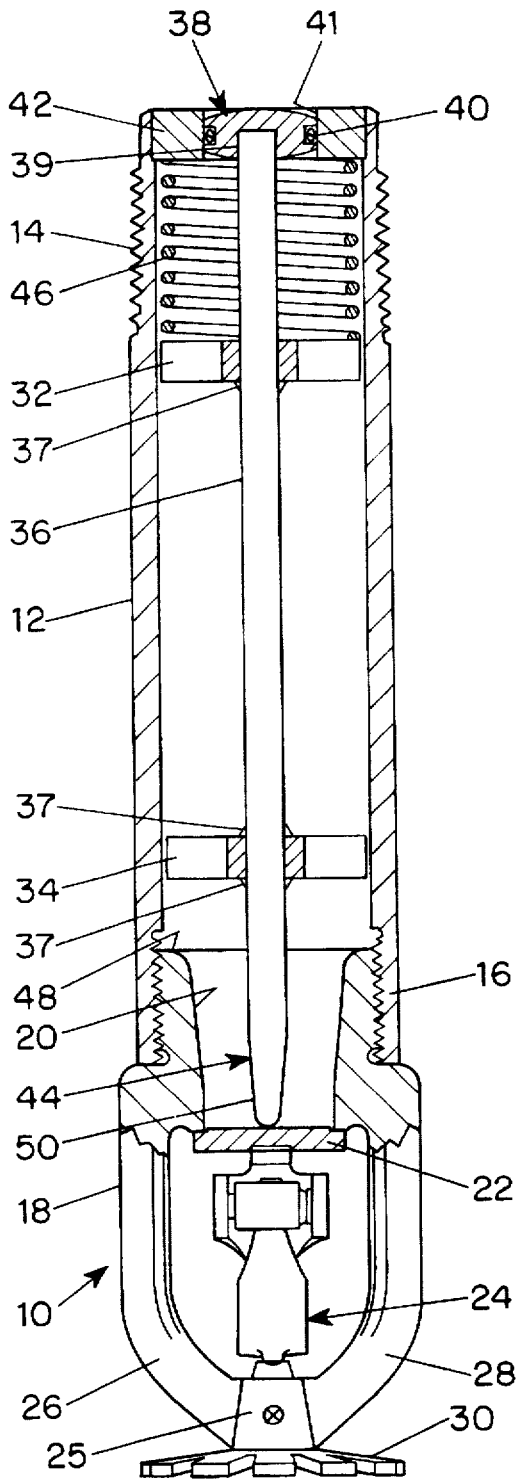
FIG. 1 is a longitudinal sectional view illustrating a representative embodiment of the invention in the unactuated condition.
Figure 2:
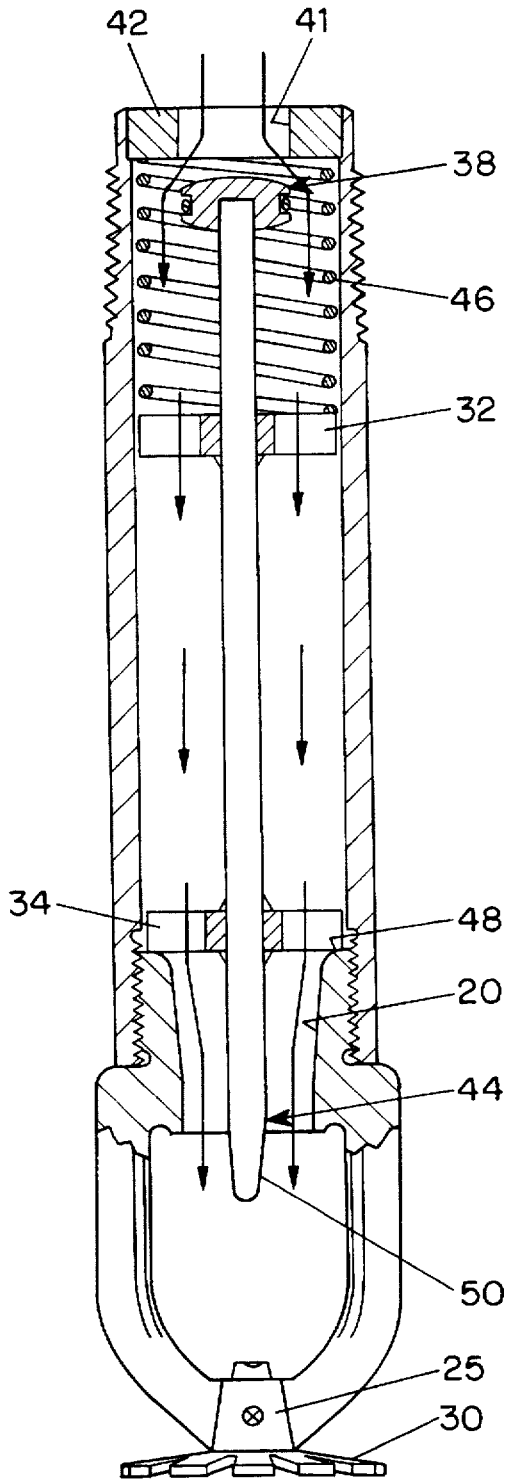
FIG. 2 is a longitudinal sectional view illustrating the embodiment of FIG. 1 in the actuated condition.

In the typical embodiment of the invention shown in FIGS. 1 and 2, a dry sprinkler 10 includes a tube-like section 12 having an externally threaded end 14 to be connected to a water supply line (not shown) and having internal threads at the opposite end 16 to receive a conventional sprinkler head 18. If desired, the sprinkler head may be joined to the tube-like section in any other appropriate manner. The sprinkler head 18 has an internal passage 20 communicating with the interior of the pipe 12 and a cap 22 covers the end of the passage 20. The cap 22 is held in position by one end of a conventional thermally responsive structure 24 which is supported at the opposite end by a boss 25 formed at the junction of two arms 26 and 28 and a conventional deflector 30 is mounted in the usual manner on the boss 25.

Centrally positioned within the tube-like section 12 by upper and lower guide members 32 and 34 is a support rod 36 having a sealing plug 38 affixed at its upper end 39. The sealing plug 38 has a circumferential sealing ring 40 which is compressed between the plug 38 and the surface of an opening 41 in a disc 42 which is affixed in the upper end of the tube-like section 12 for example, by pressing and staking. The lower end 44 of the support rod 36 engages the cap 22 and a compression spring 46 extends between the upper guide member 32 and the inner end of the disc 42 to urge the support rod 36 downwardly against the cap 22. Thus, the sealing plug 38 is held in its sealing position as long as the cap 22 is supported in its position at the end of the passage 20 by the thermally responsively structure 24.

The guide members 32 and 34, which have radial arms spaced by angular openings as shown in FIGS. 7A–7D, are mounted in fixed position on the rod 36 for example, by pressing and staking at 37 and the upper guide member 32 is affixed at a position spaced from the disc 42 sufficiently to permit the compression spring 46 to be compressed between them. The lower guide member 34 is affixed to the support rod 36 at a position spaced from the inner end 48 of the sprinkler head 18 by a distance sufficient to permit the support rod 36 and the sealing plug 38 to move downwardly within the pipe 12 upon actuation far enough to provide an undiminished cross-section for flow of water through the opening 41 in the disc 42 and through the pipe 12 and the passage 20 without obstruction when the sprinkler has been actuated.

When the temperature in the vicinity of the sprinkler head 18 has been raised to a predetermined elevated temperature, the thermally responsive element 24 collapses, permitting the spring 46 to urge the end 44 of the support rod 36 downwardly through the end of the passage 20 forcing the cap 22, as well as the components of the thermally responsive structure 24, away from the sprinkler head 18. At the same time, the sealing plug 38 moves downwardly away from the passage 41 as shown in FIG. 2 until the lower guide member 34 engages the inner end 48 of the sprinkler head. The upper end 14 of the pipe 12 is thus open to water from the water line to which it is connected and the plug 38 is spaced from the disc 42 far enough to permit unobstructed flow of water through the opening 41 and around the plug and then through the openings between the radial arms in the guide members 32 and 34 and through the passage 20 toward the deflector 30 as illustrated by the arrows in FIG. 2.

In order to facilitate the flowing of water through the tube-like section 12 toward the deflector 30 for distribution throughout the area to be protected, the lower end 44 of the support rod 36 has a surface 50 which tapers inwardly toward its tip from a location within the passage 20 so that the water flowing through the passage 20 continues in the direction toward the deflector 30 and is not diverted away from the deflector by the lower end 44 when it protrudes downwardly from the end of the passage 20 as shown in FIG. 2.

Figure 4:
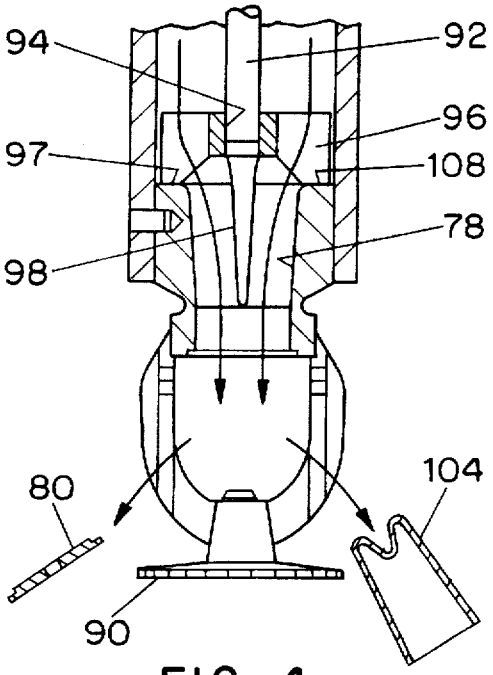
FIG. 4 is a similar view illustrating the modification of FIG. 3 in the actuated condition.
Figure 7A:
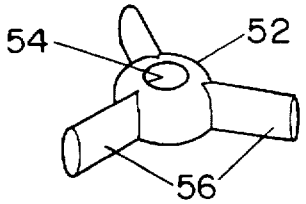
FIGS. 7A–7D illustrate typical guide members useful in the embodiments of FIGS. 1–6.
Figure 7B:
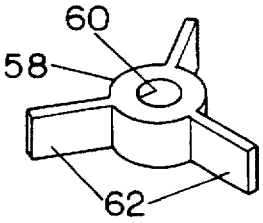
Figure 7C:
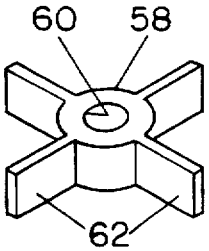
Figure 7D:
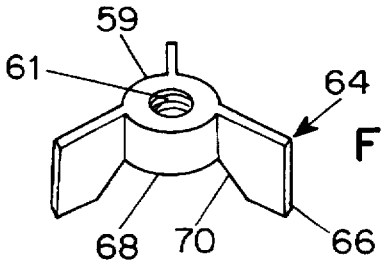
Figure 8:
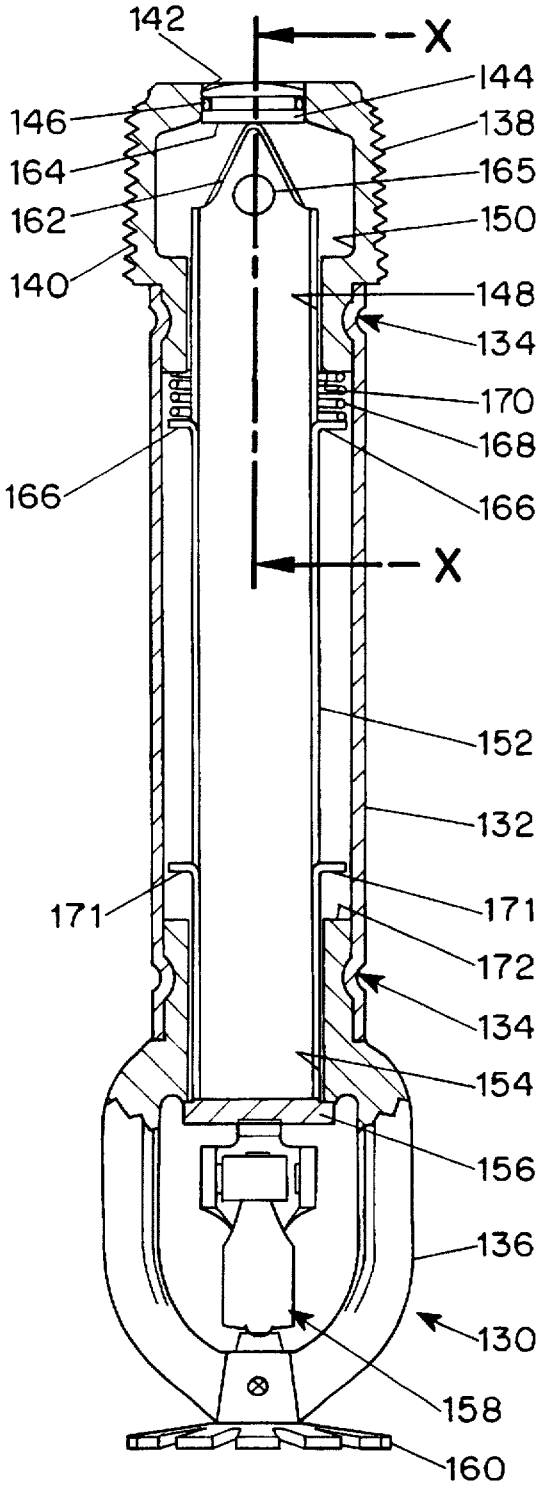
FIG. 8 is a longitudinal sectional view illustrating a further embodiment of the invention in the unactuated condition.

FIGS. 7A–7D illustrate typical arrangements for the guide members 32 and 34. In FIG. 7A the guide member has a central hub 52 with an opening 54 to receive the support rod 36 and includes three arms 56 projecting radially at uniform angles about the periphery of the hub 52, each of the arms 56 having a substantially oval or elliptical cross-section, thus providing three angular openings of about 120° between the arms for water passing through the pipe. The guide member arrangement shown in FIG. 7B has a cylindrical hub 58 with a central opening 60 to receive the rod 36 and three radial arms 62 of rectangular cross-section, providing a structure which is simple to fabricate by machining or molding. The guide member shown in FIG. 7C is similar to that of FIG. 7B, except that it has four radial arms 62 disposed at equal angles about the periphery of the hub 58, thereby providing four angular openings of about 90° for passage of water through the tube-like section. Finally, the guide member shown in FIG. 7D is similar to that of FIG. 7B but its hub 59 has an internal threaded opening 61 and its three radial arms 64 have axial projections 66 which extend beyond the end surface 68 of the hub 59 and include edge surfaces 70 which taper inwardly toward the end surface 68 of the hub 59. The length of the projections 66 beyond the end surface 68 is selected to assure an unrestricted flow of water between the hub 59 and the inner end 48 of the sprinkler head when the rod 36 is in the actuated condition as shown in FIG. 4.

With the dry sprinkler arrangement shown in FIGS. 1 and 2, a simple and inexpensive structure is provided which effectively conducts water from the upper end through the tube-like section 12 and toward the deflector 30 without requiring any parts to pass through the tube and be ejected through the sprinkler passage or parts which must be articulated or linked by a pivoting arrangement or the like within the tube section.

Figure 3:
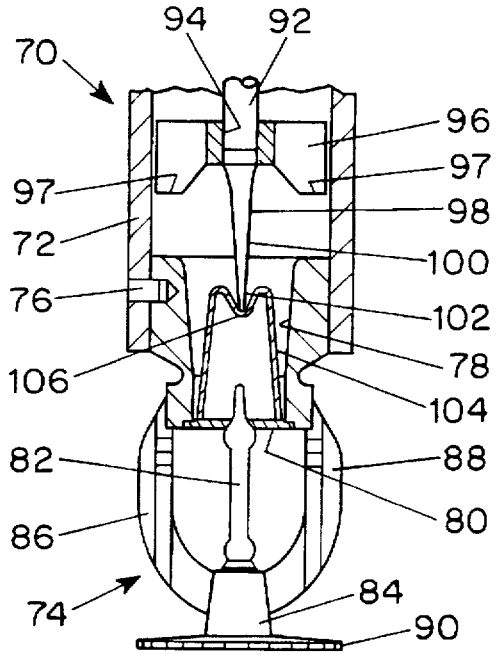
FIG. 3 is a fragmentary longitudinal sectional view illustrating a modification of the embodiment of FIG. 1 in the unactuated condition.

In the modified form illustrated in FIG. 3, a dry sprinkler arrangement 70 includes a tube section 72 and a sprinkler head 74 affixed to the tube at its lower end by pins 76 and having a passage 78 covered by a cap 80 which is held in place by one end of a thermally responsive element 82. At its opposite end, the thermally responsive element 82 engages boss 84 which is formed at the junction of two spaced arms 86 and 88 and supports a deflector 90.

Within the tube section 72, a support rod 92 has its lower end threaded into the upper end of the central opening 94 of a guide member 96 of the type shown in FIG. 7D having axially projecting ends 97, a separate tip member 98 being threaded into the lower end of the opening 94. The tip member 98 has a tapering external surface 100 for facilitating the maximum flow of water through the passage 78 toward the deflector 90 without causing the water to be diverted outwardly away from the deflector 90 as described above with respect to FIGS. 1 and 2. In this case the lower end 102 of the tip member 98 is supported by a spacer 104 which has a central dimple 106 receiving the end 102 of the tip member 98.

When the sprinkler is actuated by elevation of the thermally responsive member 82 above its operating temperature, the compression spring 46 at the upper end of the support rod 92 urges the support rod downwardly, forcing the cap 80 and the spacer 104 away from the passage 78. The support rod 92 then moves downwardly until the axially projecting ends 97 of the radial arms of the lower guide member 96 engage the inner end 108 of the sprinkler head 74, positioning the tapered surface 100 of the tip member 98 within the passage 102 so as to facilitate the flow of water through the passage in a direction toward the deflector 90 as illustrated by the arrows in FIG. 4.

As in the embodiment described previously, this arrangement permits water to be conducted through the tube section in a substantially unobstructed manner and facilitates the flow of water toward the deflector 90 without requiring any parts to pass through the tube section or requiring hinged or articulated parts within the tube.

Figure 5:
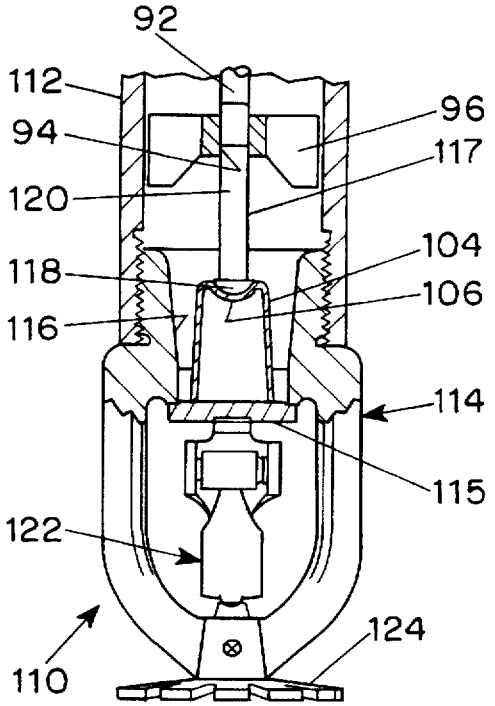
FIG. 5 is a partial longitudinal sectional view illustrating a further modification of the embodiment of FIG. 1.
Figure 6:
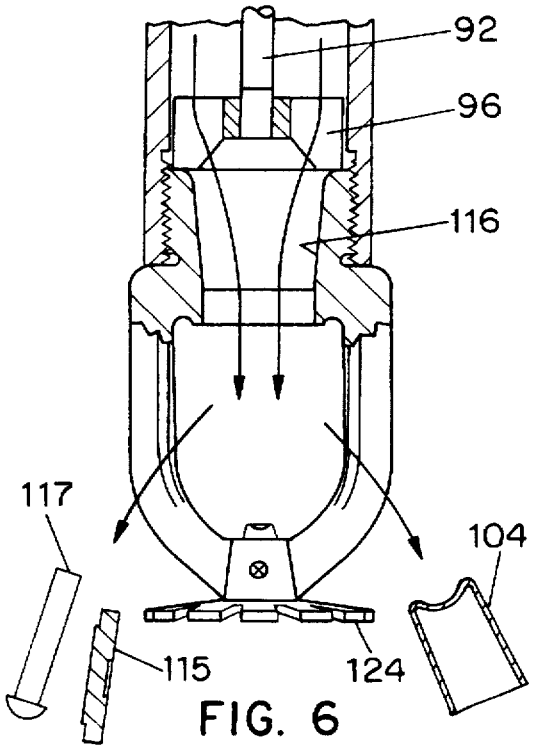
FIG. 6 is a similar view illustrating the modification of FIG. 5 in the actuated condition.

In the further modification shown in FIGS. 5 and 6, a dry sprinkler 110 includes a tube-like section 112 having a sprinkler head 114 threadedly mounted at the lower end. In this embodiment a support rod 92 carries guide members 96 having radial arms with axial projections 97 of the same type described above and a spacer 104 of the type previously described with respect to FIGS. 3 and 4 is interposed between the support rod and a cap 115 which covers a sprinkler passage 116. In this case, however, a separable rod tip 116 has one end 118 received in the dimple 106 of the spacer 104 and the other end 120 inserted with clearance into the lower end of the threaded opening 94 in the guide member, the entire structure being supported by the cap 115 as long as a thermally responsive release member 122 remains unactuated.

Upon actuation, as shown in FIG. 6, the separable tip 117 is ejected from the sprinkler head along with the spacer 104 and the cap 115, permitting water to flow in an unobstructed manner through the sprinkler passage 116 and facilitating flow of water toward the deflector 124 as shown by the arrows in FIG. 6.

In the further embodiment of the invention illustrated in FIGS. 8–11, a dry sprinkler arrangement 130 includes a tube-like section 132 affixed by pressure-formed connections 134 to a sprinkler head 136 at one end and to a water supply line connection 138 at the opposite end. The water supply line connection 138 has external threads 140 for connection to a water supply line and has an internal ending formed with a central opening 142 in which a sealing plug 144 having a peripheral gasket 146 is supported in a sealing relationship. The water supply line connection 138 also has a passage 148 at the opposite end of similar diameter to the opening 142. Between the opening 142 and the passage 148 the water supply line connection 138 is formed with a cavity 150 having a diameter which is larger than that of the opening 142 and the passage 148 by an amount at least equal to the axial length of the sealing plug 144.

Within the tube section 132 an inner tube 152 extends slidably through the opening 148 in the water supply line connection 138 and through a corresponding opening 154 in the sprinkler head 136 and the lower end of the tube 152 engages a cap 156 which is supported in position in the sprinkler head 136 by a thermally responsive structure 158. In addition, a deflector 160 is mounted in the usual manner at the outer end of the sprinkler head.

Figure 10:
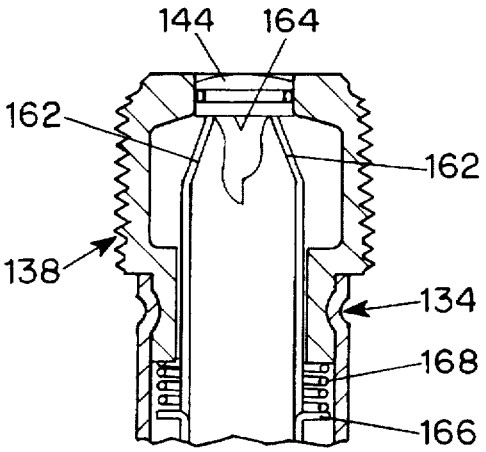
FIG. 10 is a fragmentary sectional view taken along the line X—X of FIG. 8 and looking in the direction of the arrows.

In order to support the sealing plug 144 in its sealing position in the opening 142, the inner tube 152 is formed at the upper end with two laterally spaced triangular tips 162 which, as best seen in FIG. 10, project from opposite sides of the tube and engage the inner surface 164 of the sealing plug 144 to support it in position. As shown in FIG. 10 passages are provided between the tips 162 to permit water to flow from the cavity 150 into the inner tube 152. Moreover, each of the tips 162 has an opening 165 providing an additional passage for water to flow from the cavity 150 into the inner tube 131. At a location spaced from the water supply line connection the inner tube 152 is formed with outwardly projecting spring stop tabs 166 and a compression spring 168 is compressed between the tabs 166 and the inner end 170 of the water supply line connection 138 so as to urge the inner tube 152 downwardly toward the cap 156. Two further tabs 171, which project outwardly from the lower end of the inner tube 152 at locations normally spaced from the inner end 172 of the sprinkler head 136, are engageable with the sprinkler head when the sprinkler has been actuated, thereby providing a stop for the downward motion of the inner tube following actuation.

Figure 9:
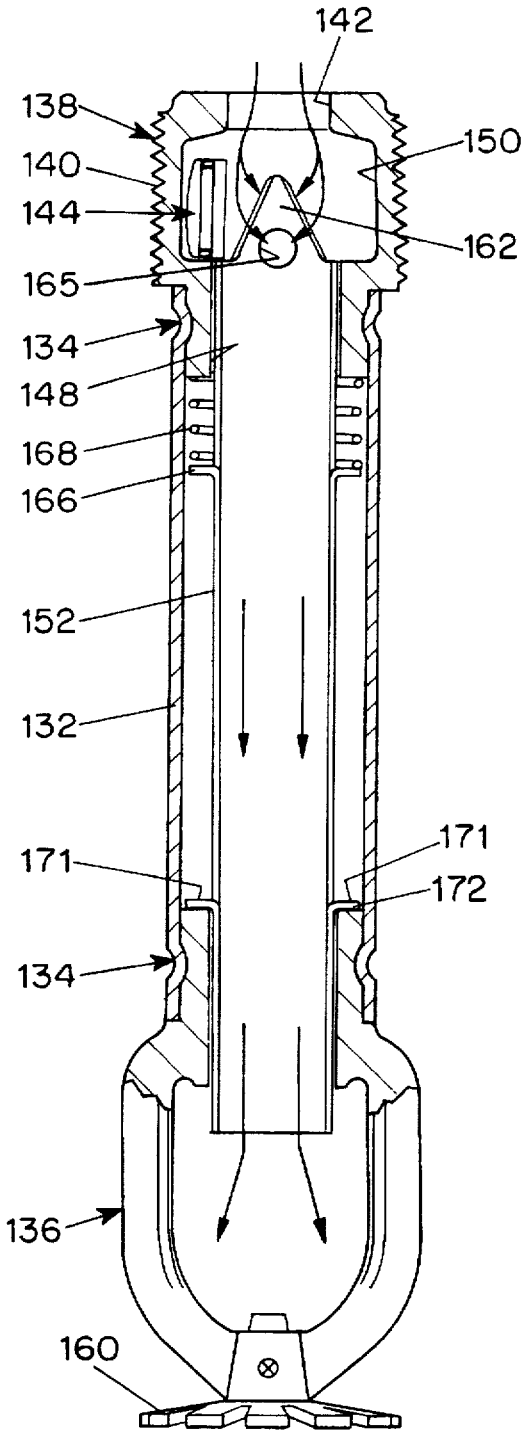
FIG. 9 is a similar view illustrating the embodiment of FIG. 8 in the actuated condition.
Figure 11:
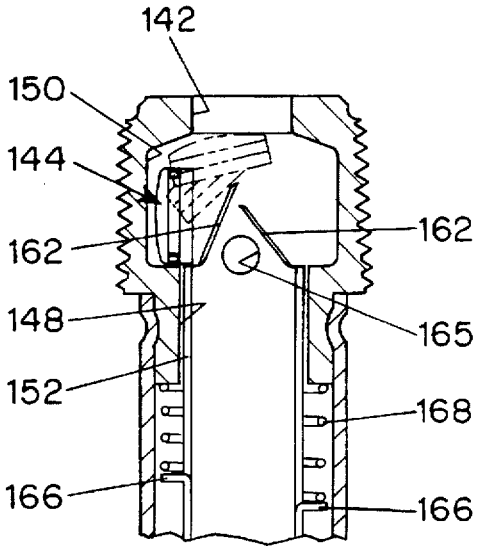
FIG. 11 is a fragmentary sectional view of the embodiment shown in FIG. 8 illustrating the operation of that embodiment.

Upon actuation of the sprinkler by collapse of the thermally responsive structure 158, the spring 168 forces the inner tube 152 downwardly, ejecting the structure 158 and the cap 156 from the sprinkler head and moving downwardly until the outwardly projecting tabs 171 engage the inner end 172 of the sprinkler head as shown in FIG. 9. Successive positions of the upper end of the inner tube 152 during its downward motion are illustrated in the left and right halves, respectively, of FIG. 11 and as shown in dotted lines the sealing plug 144, no longer supported by the upper ends of the triangular tips 162, tilts sidewardly on the tips 162 and is guided by their sloping surfaces into a position out of the water flow path in the side recess of the cavity 150. As a result, as shown by the arrows in FIG. 9, water enters the inner tube 152 by flowing through the passages between the projecting tips 162 and also through the openings 165 in the walls of the tube communicating between the cavity 150 and the interior of the tube. The water thus follows an unobstructed path between the opening 142 in the installation head 138 through the inner tube 152 and toward the deflector 160 at the outer end of the sprinkler head 136.

Figure 12:
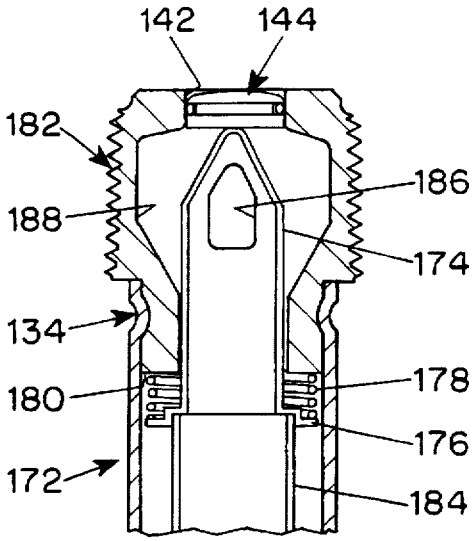
FIG. 12 is a fragmentary longitudinal sectional view illustrating a modification of the embodiment shown in FIG. 8.

In the modified form of the invention shown in FIG. 12, a dry sprinkler 172 is the same as that shown in FIGS. 8–11, except that the inner tube includes a conical tip part 174 having a projecting flange 176 to engage a compression spring 178 which is seated at the opposite end against the inner end 180 of a water supply line connection 182. The inner tube also has a lower part 184 which is the same as the lower part of the inner tube 152 of the embodiment of FIGS. 8–11. In this embodiment, the conical tip 174 has a plurality of lateral openings 186 providing a total water flow area large enough to permit passage of all of the water received through the opening 142 in the water supply line connection 182. The water supply connection also has an internal cavity 188 which slopes inwardly toward the conical tip 174 to guide the tip as it is actuated away from the supporting seal 144.

Figure 13:
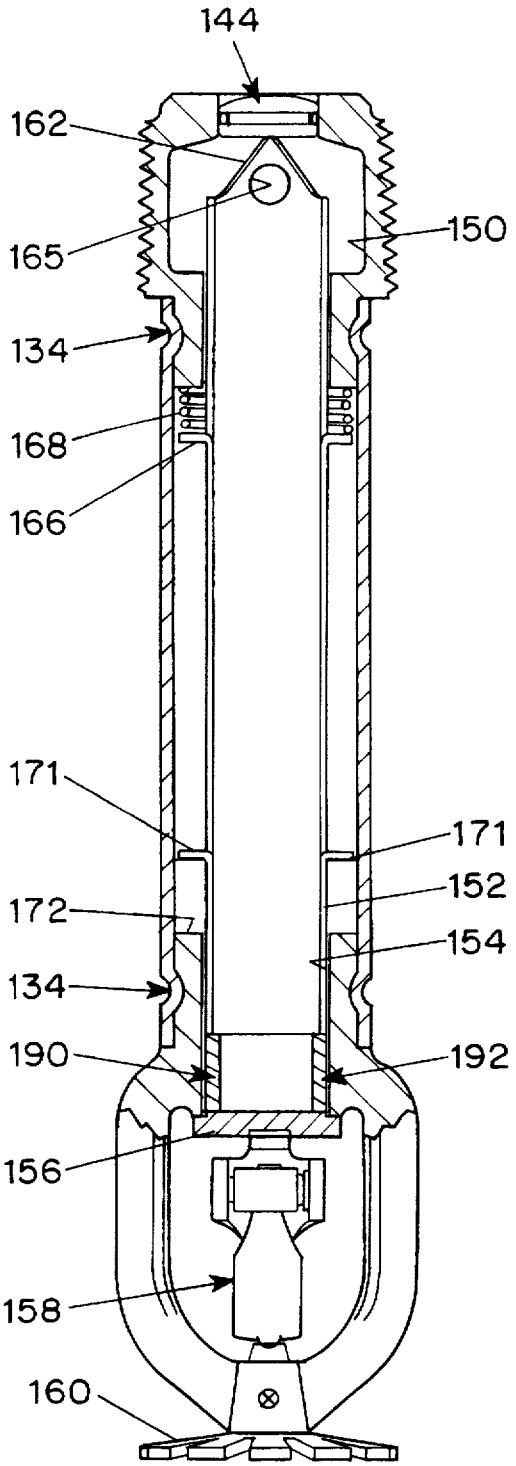
Figure 14:
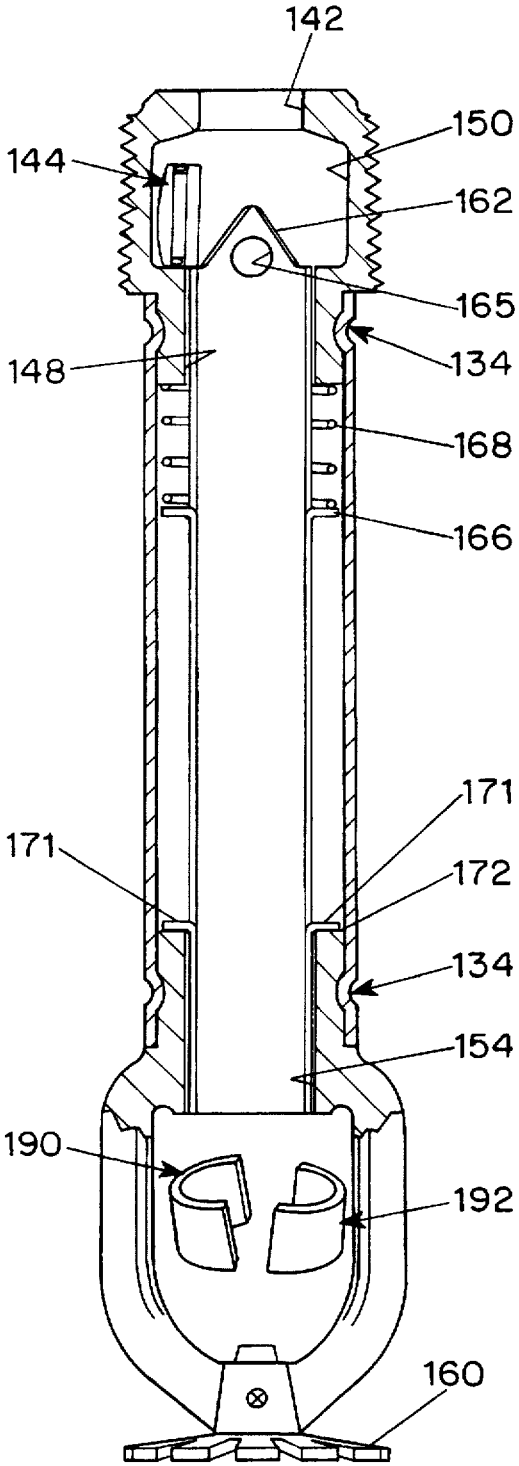

In a further modification shown in FIGS. 13 and 14, a split ring consisting of two half rings 190 an 192 is interposed between the lower end of the inner tube 152 and the cap 156, the structure being otherwise the same as that described in connection with FIGS. 8–11. In this case, seen in FIG. 14, the split ring parts 190 and 192 separate when the sprinkler is actuated and are therefore ejected from the sprinkler head along with the cap 156 and the thermally responsive structure 158. As a result, the inner tube 152 does not project beyond the passage 154 in the sprinkler head when the sprinkler is actuated, thereby avoiding interference with the flow of water through the inner tube 152 toward the deflector 160.

Although the invention has been described herein with reference to specific embodiments, many modifications and variations therein will readily occur to those skilled in the art. Accordingly, all such variations and modifications are included within the intended scope of the invention.

I claim:

1. A dry sprinkler comprising:

a tube section, a sprinkler head having a deflector mounted at one end of the tube section, a water supply line connection at the other end of the tube section having an opening to receive water from a water supply line, a sealing plug normally positioned in the opening to prevent pressurized air or water from entering the tube section from the water supply line, a sealing plug support structure extending through the tube section and having a first end supporting the sealing plug and a second end, and a thermally responsive structure in the sprinkler head adjacent to the second end of the sealing plug support structure and arranged to maintain the sealing plug support structure in position to support the sealing plug in its sealing position and to permit the sealing plug support structure to move toward the sprinkler head, releasing the sealing plug from its sealing position, in response to an elevated temperature condition, wherein the second end of the sealing plug support structure has a continuously inwardly tapered outer surface so as to be generally conical in cross section to facilitate flow of water through the tube section and toward the deflector upon actuation of the dry sprinkler.

2. A dry sprinkler according to claim 1 wherein the sealing plug support structure comprises a rod centrally disposed within the tube section and a plurality of guide members mounted on the rod each having a plurality of angularly spaced radial arms directed toward the inner surface of the pipe.

3. A dry sprinkler according to claim 2 wherein a guide member mounted on the rod adjacent to the sprinkler head has a hub mounted on the rod and includes radial arms which extend axially beyond the hub toward the sprinkler head to facilitate the flow of water toward the deflector.

4. A dry sprinkler according to claim 3 including a spacer between the end of the rod adjacent to the sprinkler head and the thermally responsive structure, the spacer being releasable from the dry sprinkler upon actuation of the sprinkler.

5. A dry sprinkler according to claim 1 wherein the water supply line connection comprises a threaded portion of the tube section.

6. A dry sprinkler according to claim 2 wherein at least one guide member has a hub with a threaded opening received on a threaded portion of the rod.

7. A dry sprinkler according to claim 6 wherein the radial arms of the guide member having the threaded opening extend axially beyond the end of the guide member hub toward the sprinkler head.

* * * * *